US007392679B1

(12) United States Patent
Ghiran et al.

(10) Patent No.: US 7,392,679 B1
(45) Date of Patent: Jul. 1, 2008

(54) HYDROFORM TUBE SEALING ASSEMBLY

(75) Inventors: Mike M. Ghiran, Lake Orion, MI (US); Terry A. Kent, East China, MI (US); George T. Winterhalter, Sr., Berkley, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/861,322

(22) Filed: Sep. 26, 2007

Related U.S. Application Data

(63) Continuation-in-part of application No. 11/674,271, filed on Feb. 13, 2007, now abandoned.

(51) Int. Cl.
*B21D 9/15* (2006.01)
*B21D 26/02* (2006.01)

(52) U.S. Cl. ..... 72/58; 72/62; 72/370.22; 29/421.1

(58) Field of Classification Search ..... 72/58, 72/60, 61, 62, 370.22; 29/421.1
See application file for complete search history.

(56) References Cited

U.S. PATENT DOCUMENTS 5,233,854 A * 8/1993 Bowman et al. ..... 72/58
5,233,856 A * 8/1993 Shimanovski et al. ..... 72/62
5,239,852 A * 8/1993 Roper ..... 72/58
5,321,964 A * 6/1994 Shimanovski et al. ..... 72/62
5,865,054 A * 2/1999 Roper ..... 72/58
6,154,944 A * 12/2000 Mason et al. ..... 29/421.1
6,502,822 B1 * 1/2003 Brown ..... 72/58
6,637,246 B1 * 10/2003 Shimanovski et al. ..... 72/62
6,732,560 B1 * 5/2004 Winterhalter et al. ..... 72/62
7,140,217 B1 * 11/2006 Marks et al. ..... 72/62

* cited by examiner

*Primary Examiner*—David B Jones

(57) ABSTRACT

A hydroform seal assembly includes a seal housing and an annular nozzle carried by the seal housing and sized to insert into a tube end. A first actuator moves the seal housing to insert the nozzle. A plurality of jaws are carried by the seal housing and are movable radially inward into clamping engagement with the tube to clamp the tube onto the annular nozzle. A cam bushing is movably mounted within the seal housing, surrounds the jaws, and has cam surfaces complimentary with cam surfaces provided on the jaws so that movement of the cam bushing relative the jaws will cam the jaws radially inward. A backup cam is movable within the seal housing. The cam bushing and backup cam have complimentary cam surfaces by which movement of the backup cam will forcibly move the cam bushing relative the seal housing. A second actuator moves the backup cam.

20 Claims, 7 Drawing Sheets

HYDROFORM TUBE SEALING ASSEMBLY

RELATED APPLICATION

This application is a continuation-in-part of U.S. Ser. No. 11/674,271 filed Feb. 13, 2007.

TECHNICAL FIELD

The present invention relates generally to hydroforming and, more particularly, to a hydroform die tube sealing assembly sealing the end of a tube during hydroforming.

BACKGROUND OF THE INVENTION

It is known that a tube may be hydroformed to a desired complex shape. The tube is placed between a pair of dies having cavities which will define the resultant shape of the tube. The ends of the tube are accessible through the die and a seal is connected to each end of the tube. Pressurized fluid is injected through one of the seals to force the tube to expand into the shape of the die cavity.

It is desirable that the seal be sufficiently able to withstand the high operating pressures required for hydroforming. It is also desirable that the seal be durable to permit its repeated use without excessive maintenance, repair or replacement in the harsh manufacturing environment of high pressure hydroforming.

As a result, it would be desirable to provide a new and improved hydroform die sealing assembly of high durability and consistently assured sealing against leakage.

SUMMARY OF THE INVENTION

Accordingly, the present invention is a hydroform die tube sealing assembly. The hydroform seal assembly includes a seal housing and an annular nozzle carried by the seal housing and sized to insert into a tube end. A first actuator moves the seal housing to insert the nozzle. A plurality of jaws are carried by the seal housing and are movable radially inward into clamping engagement with the tube to clamp the tube onto the annular nozzle. A cam bushing is movably mounted within the seal housing, surrounds the jaws, and has cam surfaces complimentary with cam surfaces provided on the jaws so that movement of the cam bushing relative the jaws will cam the jaws radially inward. A backup cam is movable within the seal housing. The cam bushing and backup cam have complimentary cam surfaces by which movement of the backup cam will forcibly move the cam bushing relative the seal housing. A second actuator moves the backup cam.

BRIEF DESCRIPTION OF THE DRAWINGS

The present invention will become more fully understood from the detailed description and the accompanying drawings, wherein.

DESCRIPTION OF THE PREFERRED EMBODIMENT

Figure 1:
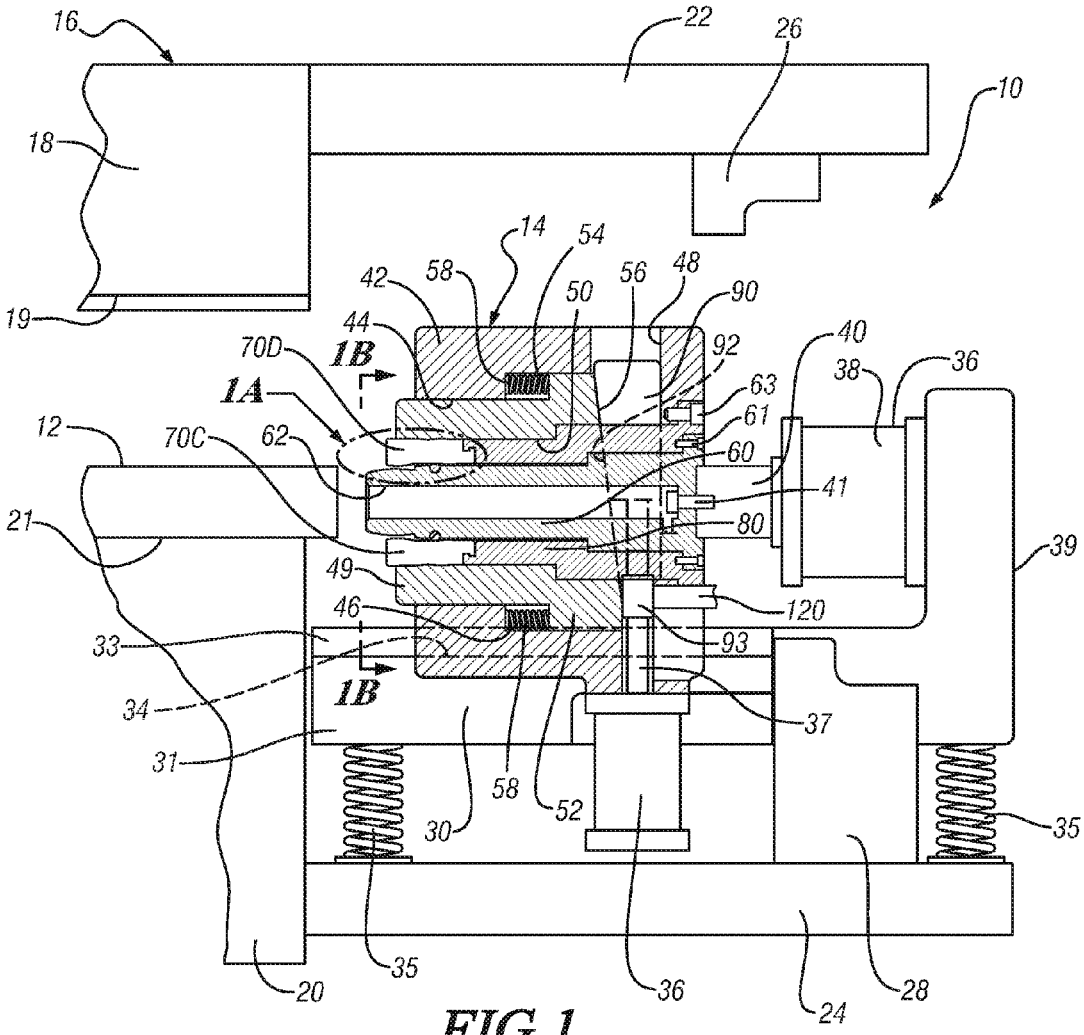
FIG. 1 is a fragmentary elevation view having parts broken away and in section, of a hydroform die tube sealing assembly, according to the present invention.
Figure 1A:
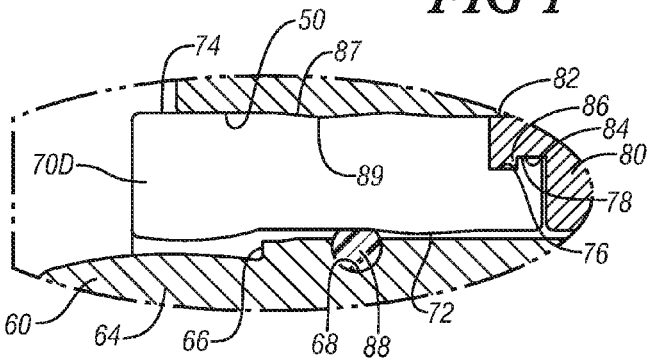
FIG. 1A is an enlarged view of a portion in oval 1A of the hydroform die tube sealing assembly of FIG. 1.

Referring to the drawings and in particular FIGS. 1 and 1A, a tube sealing assembly 10, according to the present invention, is shown for hydroforming a tube or tubular member 12. The tube sealing assembly 10 includes a seal unit, generally indicated at 14, to seal the open end of the tube 12. A similar tube sealing assembly 10 and seal unit 14 would be provided at the other end of the tube 12.

A die set, generally indicated at 16, is comprised of an upper die half 18 and a lower die half 20. The upper die half 18 includes a cavity portion 19 and the lower die half 20 includes a cavity portion 21 for receiving the tubular member 12. It should be appreciated that the upper die half 18 and lower die half 20 will be progressively closed from the position of FIG. 1 so that the tubular member 12 will be captured within the cavity portions 19 and 21 of the die set 16.

An upper mounting plate 22 is connected to the upper die half 18 and a lower mounting plate 24 is connected to the lower die half 20, by suitable fasteners (not shown). The mounting plates 22 and 24 are generally rectangular in shape. The mounting plates 22 and 24 are made of a rigid material such as metal. The mounting plates 22 and 24 extend longitudinally from the die halves 18 and 20 and are spaced from and oppose each other.

An upper support block 26 connected to the upper mounting plate 22 and a lower support block 28 connected to the lower mounting plate 24 by a suitable fasteners (not shown), and will be discussed further hereinafter.

The tube sealing assembly 10 is mounted on a seal unit elevator member 30 supported on the mounting plate 24 attached to the lower die half 22. The seal unit elevator member 30 includes a bed 31 that is mounted on the lower mounting plate 24 by a plurality of springs 35, which are preferably nitrogen filled die springs that will allow the elevator member 30 to rise and fall somewhat relative the lower mounting plate 24 so that the seal unit 14 can align itself with the end of the tube 12. The lower support block 28 engages the end of the bed 30 and supports the bed against movement left and right while allowing up and down movement on the springs 35.

The seal unit 14 includes a seal housing 42 that is slidably supported on the elevator member 30. In particular, the bed 31 of the elevator member 30 has rails 33 which engage in channels 34 provided in the seal housing 42 so that the housing 42 can slide left and right on the bed 31 of elevator member 30. As seen in FIG. 1, the seal housing 42 is hollow and carries within it an annular nozzle 60, an annular collet retainer 80 that surrounds the annular nozzle 60, and an annular cam bushing 49 that surrounds the collet retainer 80. The annular nozzle 60 and the collet retainer 80 are bolted together by bolts 61, and the collet retainer 80 is bolted to the seal housing 42 by bolts 63. Thus the annular nozzle 60 and collet retainer 80 are fixed to the seal housing 42 and move therewith as the seal housing 42 slides left and right on the bed 31 of the elevator member 30. The annular nozzle 60 has an outer surface that is sized to fit closely within the inside of the tube 12.

The elevator member 30 has a tail 39 that extends upwardly from the bed 31 of the elevator member 30 and mounts a hydraulic cylinder 38. The hydraulic cylinder 38 has a shaft 40 that is connected to the annular nozzle 60 by a bolt 41 so that energizing the hydraulic cylinder 38 will push or pull the annular nozzle 60 and the seal housing 42 to slide left and right on the rails 33 of the elevator bed 31.

Referring again to FIG. 1, it is seen that the annular cam bushing 49 surrounds the collet retainer 60 and has an outer surface that slides with a bore 44 provided in the seal housing 42. A plurality of coil springs 58 are disposed between the housing 42 and the cam bushing 49. The springs 58 extend longitudinally between a shoulder 54 of the cam bushing 49 and a first shoulder 46 of the seal housing 42 and act to urge the cam bushing 49 axially rightward as viewed in FIG. 1.

Figure 1B:
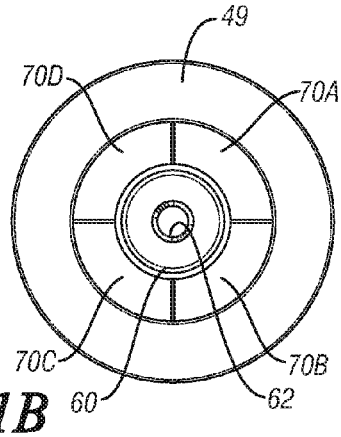
FIG. 1B is and end view taken in the direction of arrows 1B-1B of FIG. 1.

As seen in FIGS. 1, 1A, and 1B, a plurality of jaws 70A, 70B, 70C and 70D are captured between the outside of the annular nozzle 60 and the inside of bore 50 of the cam bushing 49. As best seen in FIG. 1A, the jaw 70D is coupled to the collet retainer 80 by a loose fitting interlocking structure including an annular flange 78 on the jaw 70D that fits in an annular groove 84 on the collet retainer 80, and an annular flange 86 on the collet retainer 80 that fits into an annular groove 76 on the jaw 70D. In this manner, the jaw 70D is effectively captured against removal and connected for axial movement with the collet retainer 80, while the jaw 70D can pivot or rock and shift axially somewhat relative to the collet retainer 80. The inside of the jaws 70 D rests upon an O-ring seal 88 that is seated in an annular groove 68 in the outer surface of the annular nozzle 64. The outside of the jaw 70D has a cam surface 87 thereon and a corresponding cam surface 89 is provided on the bore 50 of the cam bushing 49.

Figure 8:
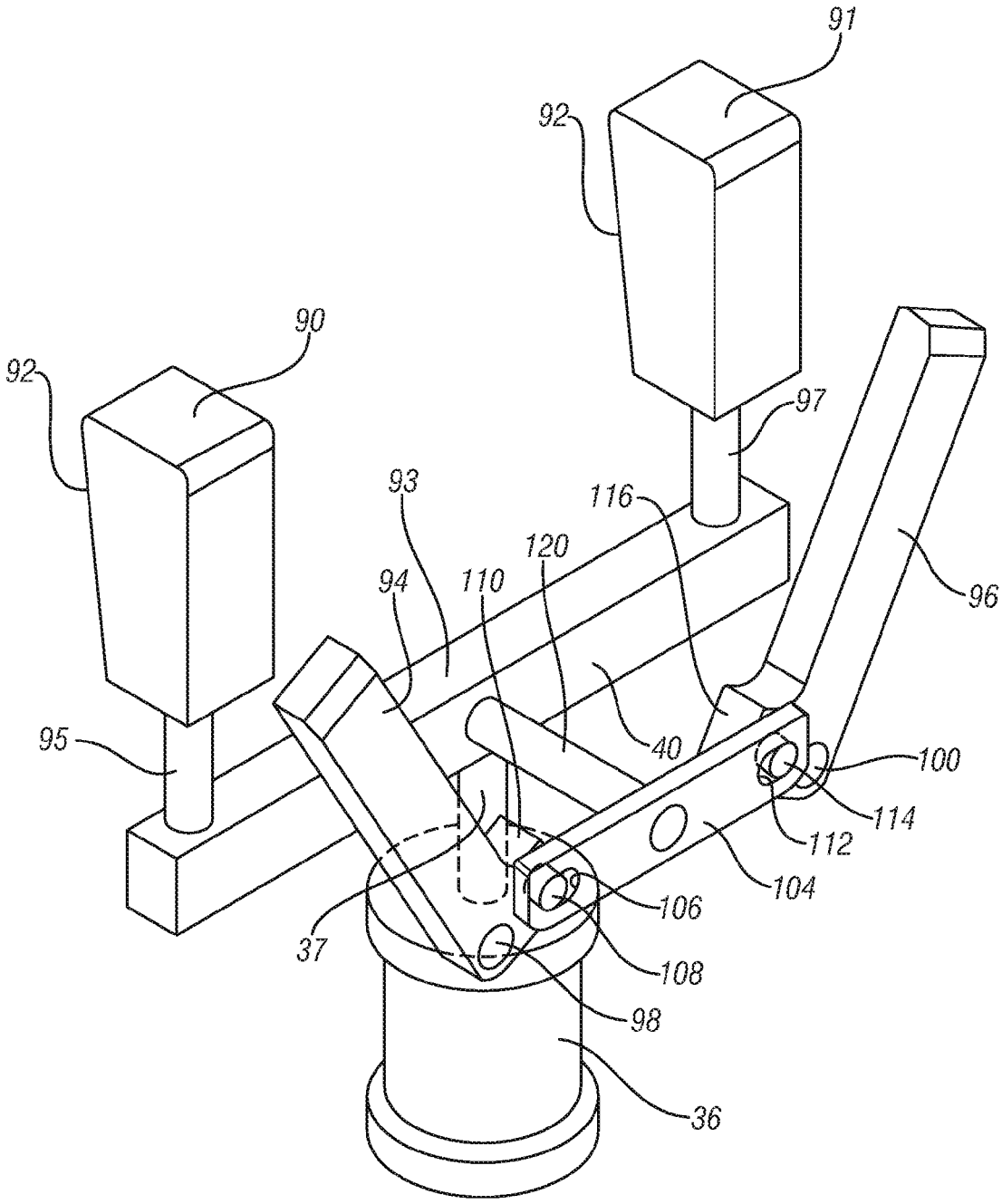
FIG. 8 is a perspective view showing the mechanism for operating the backup cams and reinforcement bars.

FIG. 1 also shows that seal housing 42 has a vertical cavity 48 provided therein in which a pair of backup cams 90 and 91 are vertically slidable. These backup cams 90 and 91, as well as the mechanism for moving the backup cams 90 and 91 are best shown in FIG. 8. As seen in FIGS. 1 and 8, the back up cams 90 and 91 are spaced apart to straddle the annular nozzle 60 and the collet retainer 80, and are moved vertically up and down, transverse to the axial direction of movement of the cam bushing 49. A hydraulic cylinder 36 is mounted on the underside of the seal housing 42 and a shaft 37 that carries a connector bar 93. Backup cam 90 has a rod 95 attached to the connector bar 93, and backup cam 91 has a rod 97 attached to the connector bar 40. As seen in FIG. 1, forward face of the backup cams 90 have inclined surfaces 92 that bears upon a complimentary inclined surface 56 provided on the cam bushing 49. Thus, as the backup cams 90 and 91 are moved up and down by the cylinder 33, the cam bushing 49 will travel right and left. And as the cam bushing 49 travels left and right, the jaws will be shifted radially inward or outward.

Figure 3:
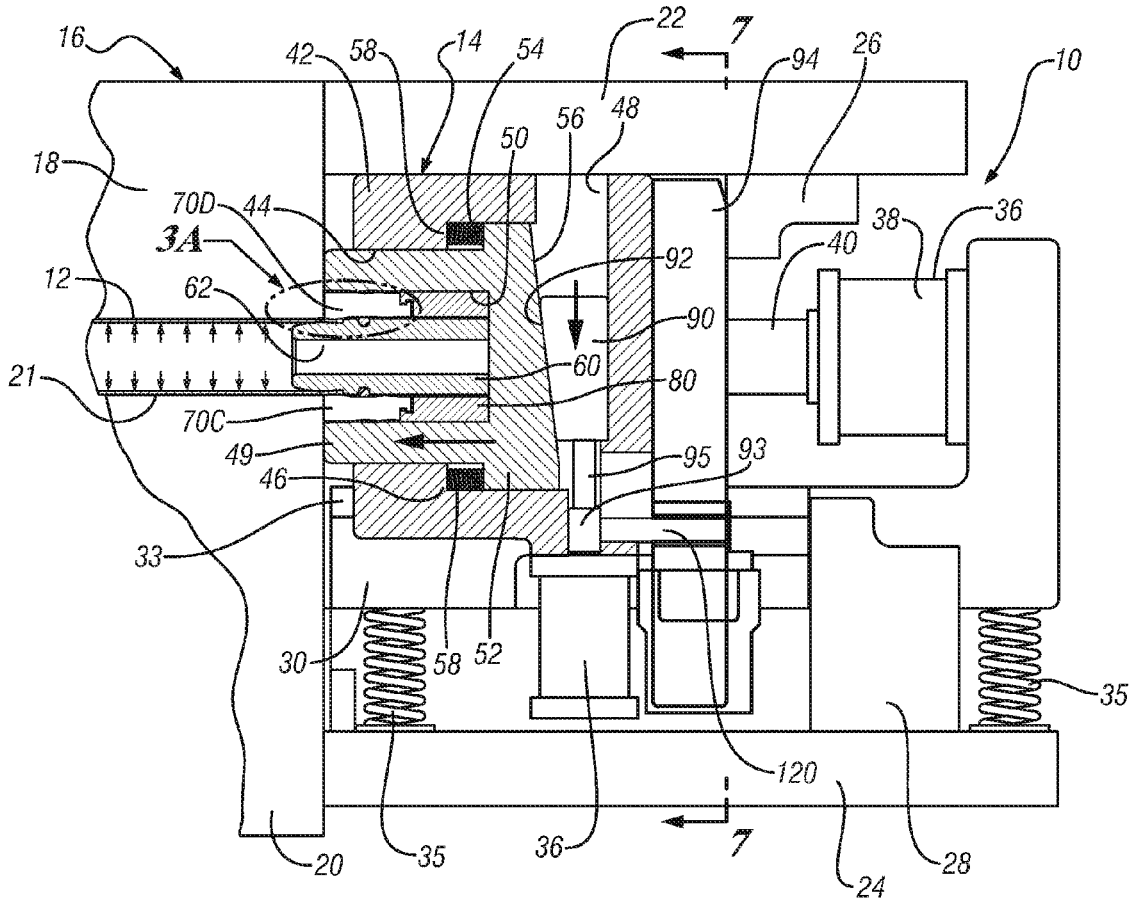
FIG. 3 is a view similar to FIG. 1 illustrating a second step of operation of the hydroform die tube sealing assembly of FIG. 1.
Figure 6:
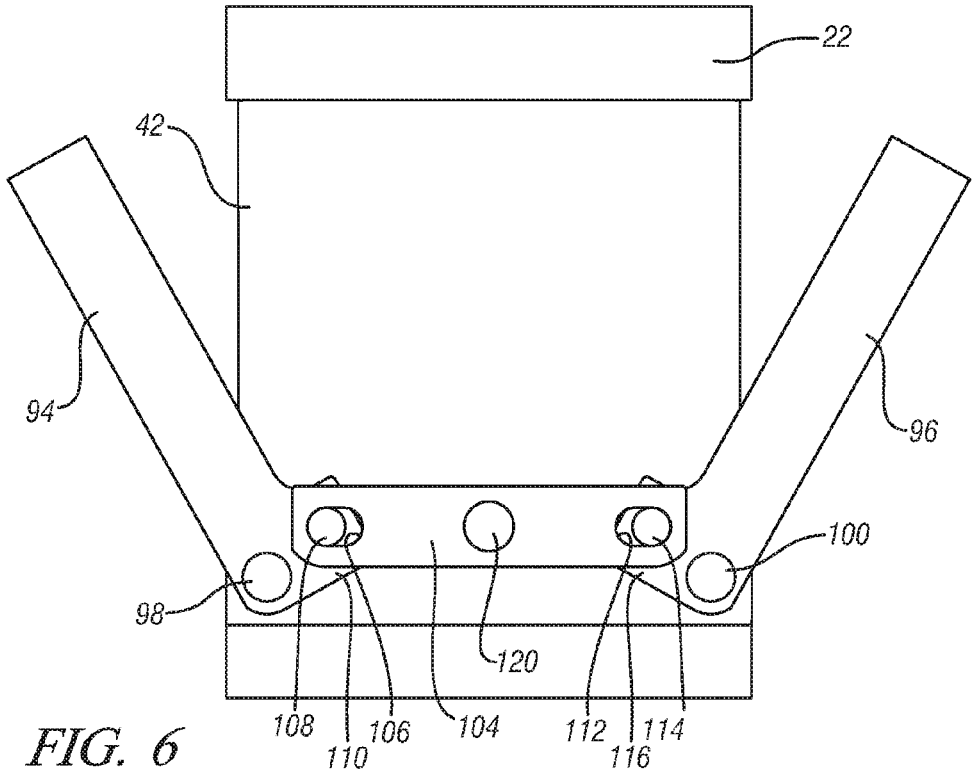
FIG. 6 is a and elevation view of the tail end of the tube sealing assembly showing reinforcement bars in open position.
Figure 7:
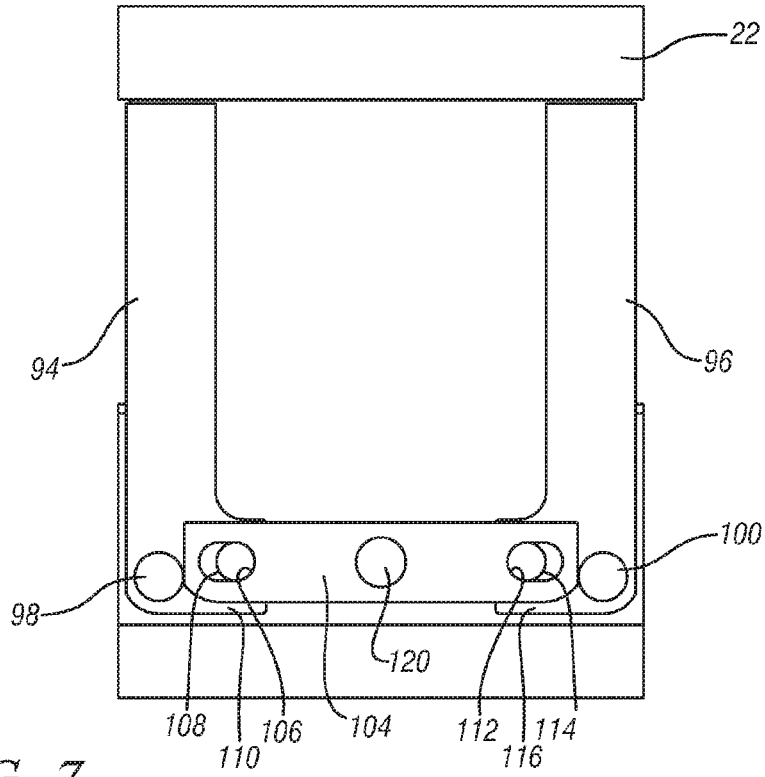
FIG. 7 is a view similar to FIG. 6 but showing the reinforcement bars in closed position.

Referring to FIGS. 6, 7 and 8, it is seen that reinforcement bars 94 and 96 are pivotally mounted at their lower ends to the seal housing 42 by pivot bolts 98 and 100. A connecting arm 104 has a slot 106 at its left end which fits over a pin 108 carried on an offset arm 110 of the reinforcement bar 90. The right hand end of the connecting bar 104 has a slot 112 that fits over a pin 114 mounted on an offset arm 116 of the reinforcing bar 96. As best seen in FIGS. 3 and 6, a connecting rod 120 reaches from the connector bar 93 of the shaft 37 of the hydraulic cylinder 36 to the connecting bar 104. Accordingly, when the hydraulic cylinder 36 is in its extended position, the connecting rod 120 will establish the connecting arm 104 and the reinforcement bars 94 and 96 at the swung open position of FIG. 6. However, when the hydraulic cylinder 36 is actuated to pull down on the backup cams 90 and 91, the connecting rod 120 is simultaneously pulled downwardly to pull down on the connecting rod 104 and thereby pivot the reinforcing bars 94 and 96 inwardly about their respective pivots 98 and 100 to the positions of FIG. 7.

Operation

Referring to FIG. 1, it is seen that the upper die 18 is raised and a length of tube 12 has been placed into the lower die cavity 21 of lower die 20. Seal unit 14 is poised with its annular nozzle 60 spaced away from the end of the tube 12, but is generally aligned with the end of the tube 12.

Figure 2:
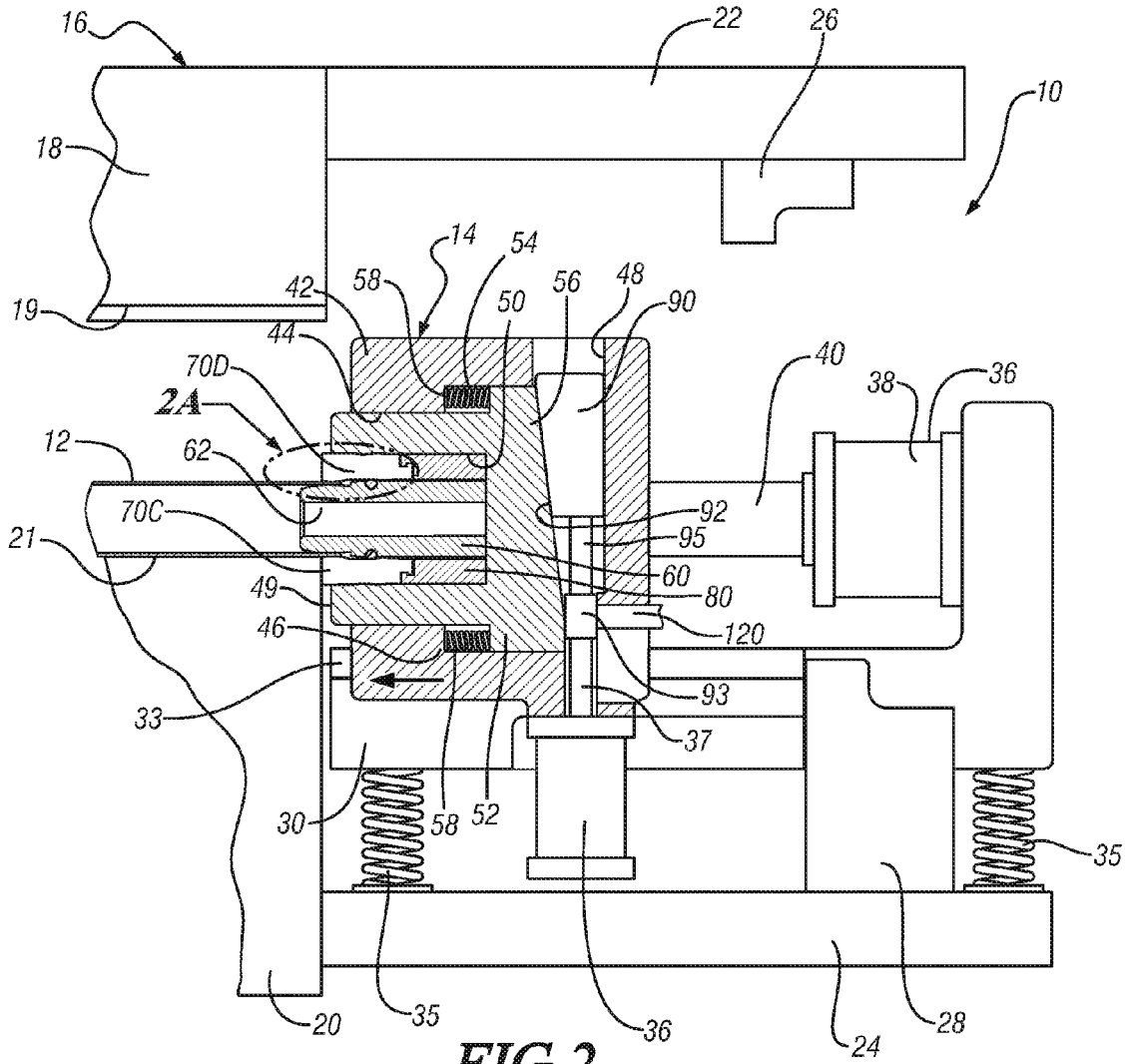
FIG. 2 is a view similar to FIG. 1 illustrating a first step of operation of the hydroform die tube sealing assembly of FIG. 1.
Figure 2A:
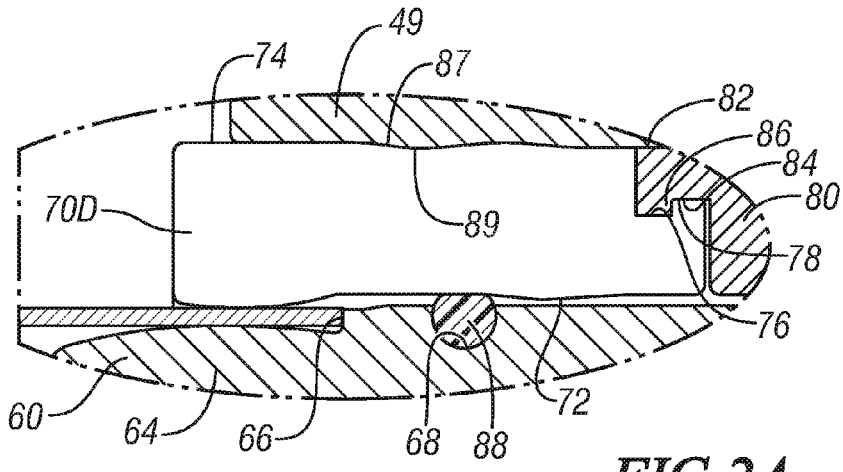
FIG. 2A is an enlarged view of a portion in oval 2A of the hydroform die tube sealing assembly of FIG. 2.

In FIG. 2, the hydraulic cylinder 38 has been actuated and its shaft 40 extended to push the seal housing 42 leftwardly to the position shown in FIG. 2, where the end of the annular nozzle 60 has been inserted into the inside of the tube 12, and the jaws 70A, 70B, 70C and 70D are poised about the outer surface of the tube 12 as shown in FIG. 2A.

Figure 3A:
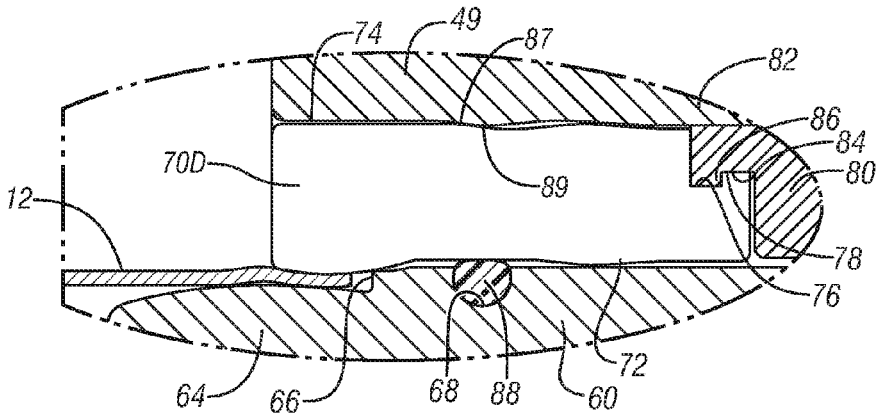
FIG. 3A is an enlarged view of a portion in oval 3A of the hydroform die tube sealing assembly of FIG. 3.

In FIG. 3, the hydraulic cylinder 36 has been actuated to pull down on the backup cams 90 and 91, thereby forcing the cam bushing 49 leftwardly relative to the seal housing 42, so that, as shown in FIG. 3A, the cam surface 89 of the cam bushing 49 has become engaged with the corresponding cam surface 87 provided on the outside of the jaw 70D, thereby forcing the jaw 70D to bodily shift radially inward into clamping contact with the outside of the tube 12. Simultaneously the other jaws 70A, B and C are also bodily shifted into clamping engagement so that the tube 12 is tightly clamped onto the outside surface of the annular nozzle 60 to provide a pressure tight seal between the tube and the nozzle 60, as shown in FIG. 3A.

As seen in FIG. 3, the hydroforming fluid at high pressure will then be introduced into the tube 12 in order to expand the tube 12 outwardly into the die cavities 19 and 21. It will be recognized that the hydroforming pressure will act on the seal unit 42 urging it to move rightwardly against the holding force of the hydraulic cylinder 38. However, as seen in FIG. 3 the actuation of the hydraulic cylinder 36 to pull down on the backup cams 90 and 91 has also caused the reinforcement blocks 94 and 96 to be swung into position of FIG. 7. And, as best seen in FIG. 3, when the reinforcing blocks 94 and 96 are swung in to be engaged against the seal housing 42, and then the upper die 16 is lowered, the upper support block 26 will be lowered into engagement with the reinforcing blocks 90 and 91, as best seen in FIG. 3. Accordingly, it is seen that the reinforcing bars 94 and 96, when engaged by the upper support blocks 26, will effectively block and restrain the seal housing 42 against any rightward movement that may be induced by the hydroforming pressure applied within the tube 12.

Figure 4:
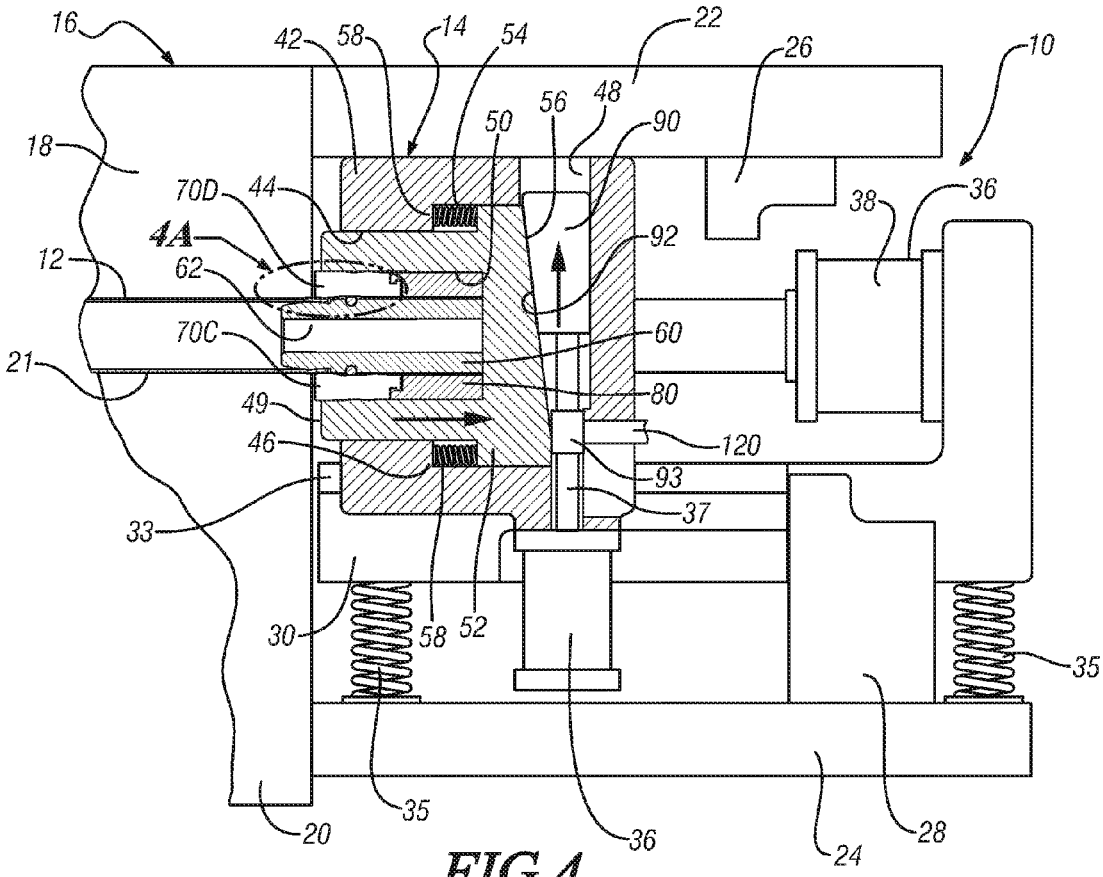
FIG. 4 is a view similar to FIG. 1 illustrating a third step of operation of the hydroform die tube sealing assembly of FIG. 1.
Figure 4A:
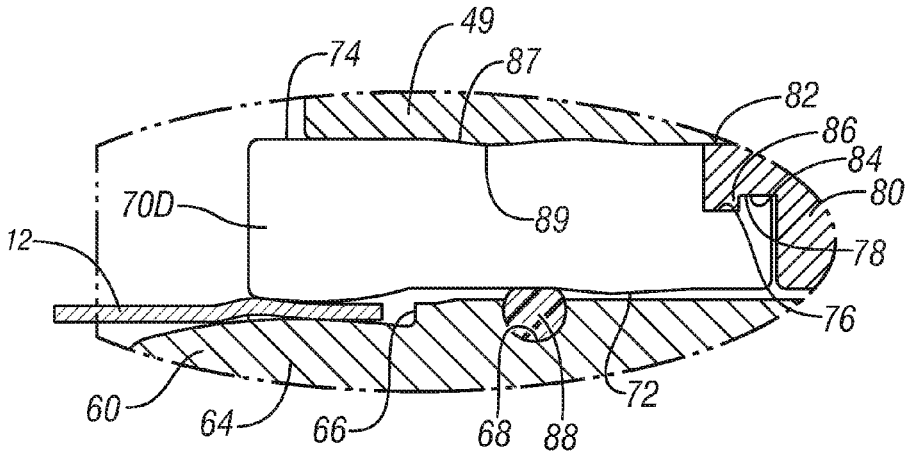
FIG. 4A is an enlarged view of a portion in oval 4A of the hydroform die tube sealing assembly of FIG. 4.
Figure 5:
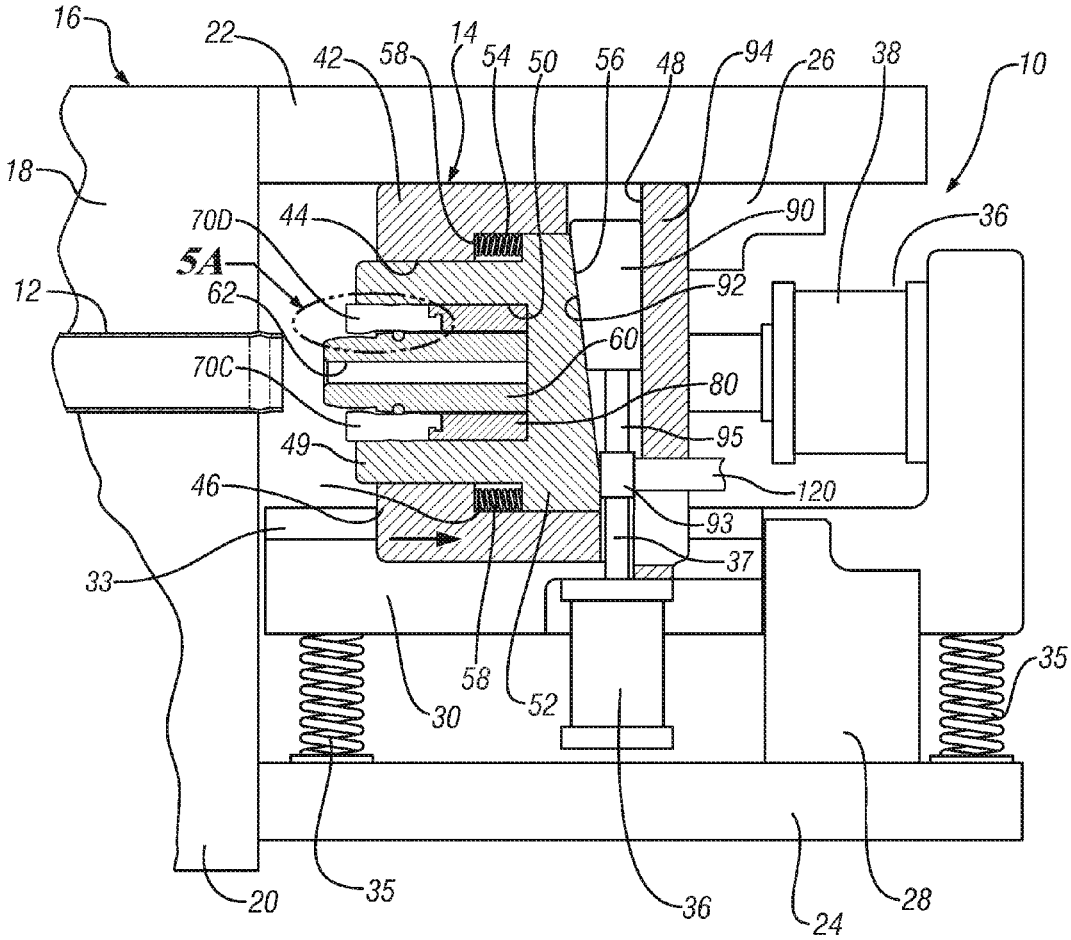
FIG. 5 is a view similar to FIG. 1 illustrating a fourth step of operation of the hydroform die tube sealing assembly of FIG. 1.

After the hydroforming pressure has been applied to the inside of the tube 12 and the tube 12 fully expanded, the pressure will then be released from the tube 12 so that the seal unit 14 may be removed. Accordingly the hydraulic cylinder 36 is actuated to lift the backup cams 90 and 91 upwardly, as shown in FIG. 4, thus permitting the springs 58 to shift the cam bushing 49 rightwardly to release the jaws 70A, 70B, 70C and 70D from their clamping engagement against the outside of the tube 12, as shown in FIG. 4A. Simultaneously the upward movement of the backup cams 90 and 91 will, acting through the connecting rod 120 and the connecting arm 104, cause the reinforcement blocks 94 and 96 to swing outwardly from their backup positions of FIG. 7 to their resting positions of FIG. 6.

The upper die 18 can be opened either before or after the cylinder 36 is extended to raise the backup cams 90 and 91 and swing open the reinforcement blocks 94 and 96.

After the backup cams 90 and 91 have been raised to release the jaws 70A, 70B, 70C, and 70 D from clamping the tube 12, the hydraulic cylinder 38 energized to retract the shaft 40 which in turn pulls the entire seal unit 14 rightwardly on the bed 31 so that the nozzle 60 is withdrawn from the end of the tube 12. Then the tube 12 can be removed from the die.

Thus, it is seen that the invention provides a new and improved seal unit for use in a hydroforming operation.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A hydroform seal assembly comprising:

a seal housing;

an annular nozzle carried by the seal housing and sized to insert into the open end of a tube to be hydroformed;

a first actuator to move the seal housing toward the open end of the tube so that the nozzle is inserted into the tube;

a plurality of jaws carried by the housing and movable radially inward into clamping engagement with the tube to clamp the tube onto the annular nozzle;

a cam bushing movably mounted within the seal housing and surrounding the jaws, said cam bushing and said jaws having complimentary cam surfaces thereon by which movement of the cam bushing relative to the jaws will cam the jaws radially inward;

a backup cam movable within the seal housing relative to the cam bushing, said back up cam and said cam bushing having complimentary cam surface thereon by which movement of the backup cam will forcibly move the cam bushing relative the seal housing;

and a second actuator for moving the backup cam.

2. The hydroform seal assembly of claim 1 further comprising a reinforcement block movable into engagement with the seal housing to block movement of the seal housing in the direction that would remove the annular nozzle from the end of the tube.

3. The hydroform seal assembly of claim 2 further comprising a support block carried by a hydroforming die which closes about the tube and which engage with the reinforcement block to assist the reinforcement block in blocking the movement of the annular nozzle from the end of the tube.

4. The hydroform seal housing of claim 2 further comprising said reinforcement block being movable by the second actuator.

5. The hydroform seal housing of claim 2 further comprising said reinforcement block being two separate reinforcement blocks that are pivotally mounted for swinging movement to swing into position blocking the movement of the seal housing.

6. The hydroform seal assembly of claim 1 further comprising a plurality of springs acting between the cam bushing and the seal housing to urge movement of the cam bushing relative to the seal housing in the direction opposite the direction of the movement of the cam bushing which moves the jaws radially inward to clamp the tube.

7. The hydroform seal assembly of claim 1 further comprising said plurality of jaws being mounted on the seal housing by a collet retainer and the plurality of jaws and the collet retainer having interlocking structures thereon by which the plurality of jaws are held against axial movement relative to the seal housing but allowed to shift radially relative the annular nozzle to clamp and unclamp the tube.

8. The hydroform seal assembly of claim 1 further comprising said backup cam being two separate backup cams that straddle the annular nozzle.

9. The hydroform seal assembly of claim 1 further comprising said first and second actuators being hydraulic cylinders.

10. The hydroform seal assembly of claim 1 further comprising the movement of the backup cam being transverse to the movement of the cam bushing.

11. A hydroform seal assembly comprising:

a seal housing;

an annular nozzle fixedly mounted on the seal housing and sized to fit closely within the open end of a tube to be hydroformed;

a first actuator to push the seal housing toward the open end of the tube so that the nozzle is inserted into the open end;

a plurality of jaws carried by the housing and radially movable into clamping engagement with the tube to clamp the tube onto the annular nozzle;

a reinforcement block movable into engagement with the seal housing to block movement of the seal housing in the direction that fluid pressure acting on the nozzle would move the seal housing to remove the annular nozzle from the open end of the tube;

and a second actuator for moving the plurality of jaws into clamping engagement and moving the reinforcement bar into engagement with the seal housing.

12. The hydroform sealing assembly of claim 11 further comprising a cam bushing slidably mounted within the seal housing and surrounding the jaws, said cam bushing and said jaws having complimentary cam surfaces thereon by which movement of the cam bushing relative to the jaws will cam the jaws radially inward.

13. The hydroform seal assembly of claim 12 further comprising a plurality of springs acting between the cam bushing and the seal housing to urge sliding movement of the cam bushing relative to the seal housing in the direction opposite the direction of sliding movement by the cam bushing which moves the jaws radially inward.

14. The hydroform sealing assembly of claim 12 further comprising a backup cam slidable within the seal housing relative to the cam bushing, said back up cam and said cam bushing having complimentary cam surfaces thereon by which movement of the backup cam will forcibly move the cam bushing relative the seal housing.

15. The hydroform sealing assembly of claim 12 said plurality of jaws being mounted on the seal housing by a collet retainer and the plurality of jaws and the collet retainer having interlocking structures thereon by which the plurality of jaws are held against axial movement but allowed to shift radially relative the annular nozzle to clamp and unclamp the tube upon sliding of the backup cam by the second actuator and sliding of the cam bushing by the backup cam.

16. The hydroform seal assembly of claim 14 further comprising said backup cam being two separate backup cams that straddle the annular nozzle.

17. The hydroform seal assembly of claim 11 further comprising said plurality of jaws being mounted on the seal housing by a collet retainer and the plurality of jaws and the collet retainer having interlocking structures thereon by which the plurality of jaws are held against axial movement but allowed to shift radially relative the annular nozzle to clamp and unclamp the tube.

18. The hydroform seal assembly of claim 11 further comprising said first and second actuators being hydraulic cylinders.

19. The hydroform seal assembly of claim 11 further comprising a support block carried by a hydroforming die in which the tube is captured and which engages with the reinforcement block to assist the reinforcement block in blocking the movement of the annular nozzle from the end of the tube.

20. The hydroform seal housing of claim 11 further comprising said reinforcement block being two separate reinforcement block that are pivotally mounted for swinging movement to swing into position blocking the movement of the seal housing.

* * * * *